US009314080B2

(12) United States Patent
Lai

(10) Patent No.: US 9,314,080 B2
(45) Date of Patent: Apr. 19, 2016

(54) ROTATING HANDLE APPARATUS FOR A LUGGAGE CASE

(71) Applicant: Wei-Hung Lai, Taichung (TW)

(72) Inventor: Wei-Hung Lai, Taichung (TW)

( * ) Notice: Subject to any disclaimer, the term of this patent is extended or adjusted under 35 U.S.C. 154(b) by 23 days.

(21) Appl. No.: 14/444,659

(22) Filed: Jul. 28, 2014

(65) Prior Publication Data

US 2016/0022001 A1 Jan. 28, 2016

(51) Int. Cl.
*B25G 1/00* (2006.01)
*A45C 13/26* (2006.01)
*B25G 1/04* (2006.01)

(52) U.S. Cl.
CPC . *A45C 13/26* (2013.01); *B25G 1/04* (2013.01); *A45C 13/262* (2013.01); *B25G 1/00* (2013.01)

(58) Field of Classification Search
CPC ..... A45C 13/26; A45C 13/262; A45C 13/28; A45C 2013/265; A45C 2013/267; A45C 2016/265; A45C 2016/267; B25G 1/04; B25G 1/00; B25G 1/046
USPC ..... 16/113.1, 114.1, 405
See application file for complete search history.

(56) References Cited

U.S. PATENT DOCUMENTS

| | | | | |
|---|---|---|---|---|
| 5,484,182 | A * | 1/1996 | Meisner | A45F 5/10 294/141 |
| 8,056,185 | B2 * | 11/2011 | Lai | A45C 13/262 16/113.1 |
| 2005/0092568 | A1 * | 5/2005 | Nordstrom | A45C 13/262 190/115 |
| 2006/0130275 | A1 * | 6/2006 | Tong | A45C 13/262 16/113.1 |
| 2010/0313383 | A1 * | 12/2010 | Lai | A45C 13/262 16/113.1 |

* cited by examiner

*Primary Examiner* — Emily Morgan
(74) *Attorney, Agent, or Firm* — Wang Law Firm, Inc.

(57) ABSTRACT

A rotating handle apparatus for a luggage case is provided with two rotation mechanisms which are disposed between the retractable rods and connected to an annular grip member of the luggage case. The rotation mechanisms are capable of adjusting and locking the handle into a rotational position which is comfortable and ergonomically beneficial to a user.

8 Claims, 8 Drawing Sheets

ROTATING HANDLE APPARATUS FOR A LUGGAGE CASE

BACKGROUND OF THE INVENTION

1. Field of the Invention

The present invention relates to a handle of a luggage case, and more particularly to a rotating handle apparatus for a luggage case.

2. Description of the Prior Art

FIG. 1 shows a conventional handle structure 10 for a draw bar of a luggage case. The handle structure 10 is a retractable handle consisting of a pair of outer tubes 11 and a pair of inner tubes 12 inserted in the outer tubes 11. The two inner tubes 12 are connected by a lower assembling member 13, and then the lower assembling member 13 is clamped against an upper assembling member 14 to form an inner space therebetween. In the inner space is disposed a handle-control mechanism (not shown) which is controlled by a press button 15 to lock/unlock the handle of the luggage case.

The lower and upper assembling members 13, 14 are clamped against each other to form a grip portion. The two ends of the lower assembling member 13 are fixed to the two inner tubes 12, so that the gripping portion is stationary and not rotatable with respect to the inner tubes 12. The handle structure 10 as shown in FIG. 1 is not ergonomically designed since it has no means of repositioning the gripping portion to align the wrist and arm of the user.

When controlling the luggage case, the user has to change wrist posture to a preferred position in which the user can provide proper and persistent gripping force comfortably. However, with the stationary type handle structure 10 as shown in FIG. 1, the user has to grip the luggage case with a discomfort hand posture, which is likely to lead to hand fatigue.

The present invention has arisen to mitigate and/or obviate the afore-described disadvantages.

SUMMARY OF THE INVENTION

The primary objective of the present invention is to provide a rotating handle apparatus for a luggage case, which is capable of adjusting and locking the handle into a rotational position which is comfortable and ergonomically beneficial to a user.

To achieve the above objective, a rotating handle apparatus for a luggage case in accordance with the present invention is disposed between two retractable rods of the handle of the luggage case, and each of the retractable rods includes a connecting tube. The handle-rotation apparatus comprises: the two connecting tubes, at one end of each of the connecting tubes being formed an assembling chamber; an annular grip member disposed between the two connecting tubes and defining an annular space, the annular grip member including two assembling portions aligned to the two assembling chambers, and two inserting holes which are in communication with the annular space and located at the two assembling portions, the annular grip member further including a through hole in communication with the annular space; a control button disposed inside the annular grip member and including a button portion and two arms extending toward the two assembling portions from the button portion, the button portion being elastically inserted in the through hole of the annular grip member; two rotation mechanisms disposed between the assembling portions of the annular grip member and the assembling chambers of the two connecting tubes, respectively, and being rotated by the control button to adjust an angle of the annular grip member with respect to the connecting tubes; wherein each of the rotation mechanisms comprises: an engaging members which is disposed in the annular space and engaged in a corresponding one of the inserting holes, each of the engaging members includes a multi-stepped hole which consists of a first circular hole, a middle ratchet hole and a second circular hole with a smaller diameter than the first circular hole; a base which is fixed in a corresponding one of the assembling chambers of the connecting tubes, and formed with a circular pillar to be inserted in the inserting holes of the annular grip member, the circular pillar is engaged in the first circular hole of a corresponding one of the engaging members, each of the assembling portions of the annular grip members and a corresponding one of the assembling chambers of the connecting tubes are rotatable with each other and pivotally connected by the bases, the bases is provided with a ratchet hole formed in the shape of the ratchet hole of the engaging members, a circular hole and a polygonal hole; a control shaft which is elastically disposed between a corresponding one of the engaging members and the base and able to move back and forth repeatedly, the control shaft includes a cylindrical section inserted in the second circular hole of the engaging member, a ratchet section engaged in the ratchet holes of the engaging member and the base, and a polygonal section which is formed in the shape of the polygonal hole and inserted through the ratchet hole and the circular hole of the base and into the polygonal hole; a driven members which is pivotally disposed in the annular space of the annular grip member, and includes a driven portion abutted against a corresponding one of the arms of the control button, and a drive portion abutted against one end of the cylindrical section of the control shaft; pressing the control button can cause movement of the driven members and the control shafts which are disposed between the annular grip member and the connecting tubes, in such a manner that the arms push the driven members, then the driven members push each of the control shafts to move between the corresponding engaging member and the base.

DETAILED DESCRIPTION OF THE PREFERRED EMBODIMENTS

Figure 1:
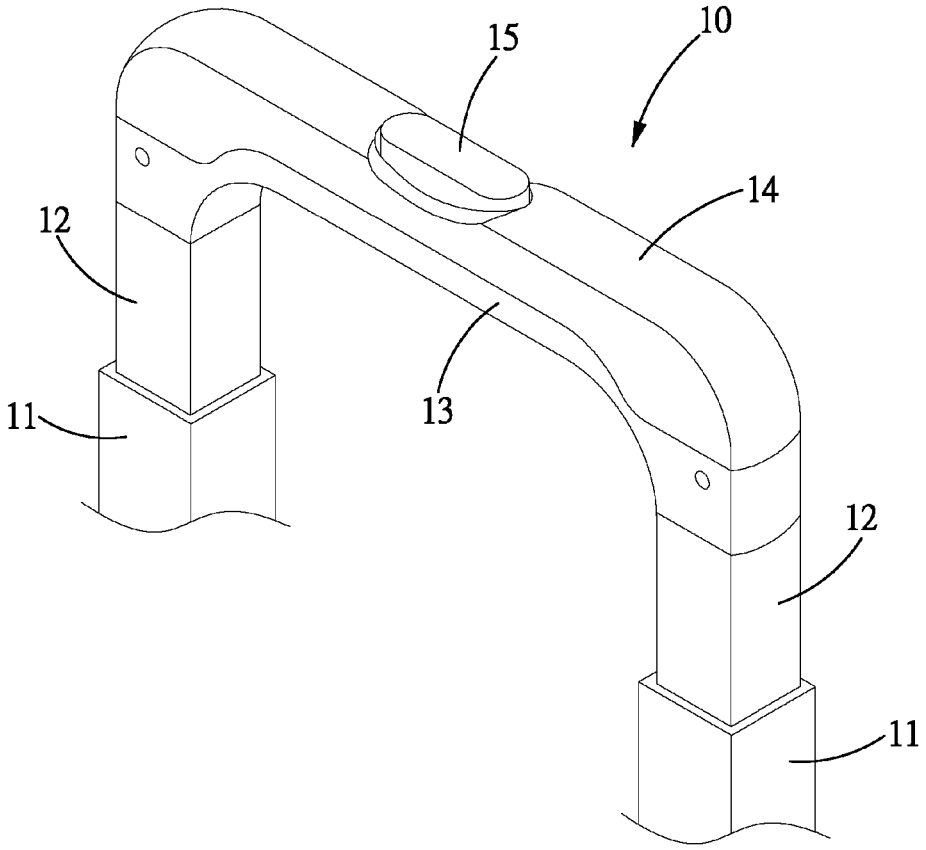
FIG.1 PRIOR ART
FIG. 1 shows a handle of a conventional luggage case.

The present invention will be clearer from the following description when viewed together with the accompanying drawings, which show, for purpose of illustrations only, the preferred embodiment in accordance with the present invention.

FIGS. 2-8 show an embodiment of a rotating handle apparatus for a luggage case in accordance with the present invention.

As shown in FIGS. 2-5, the rotating handle apparatus for the handle of a luggage case in accordance with the present invention is disposed between two retractable rods of the handle of the luggage case. Each of the retractable rods includes a connecting tube 20. The rotating handle apparatus comprises: the two connecting tubes 20, an annular grip member 30, a control button 40, and two rotation mechanisms disposed between the connecting tubes 20 and the annular grip member 30.

Each of the two connecting tubes 20 is a hollow tube. At the end of each of the connecting tubes 20 is formed an assembling chamber 21. In this embodiment, a locking pin 211 is formed in the assembling chamber 21, and at the top edge of the assembling chamber 21 are formed two engaging protrusions 212.

Figure 2:
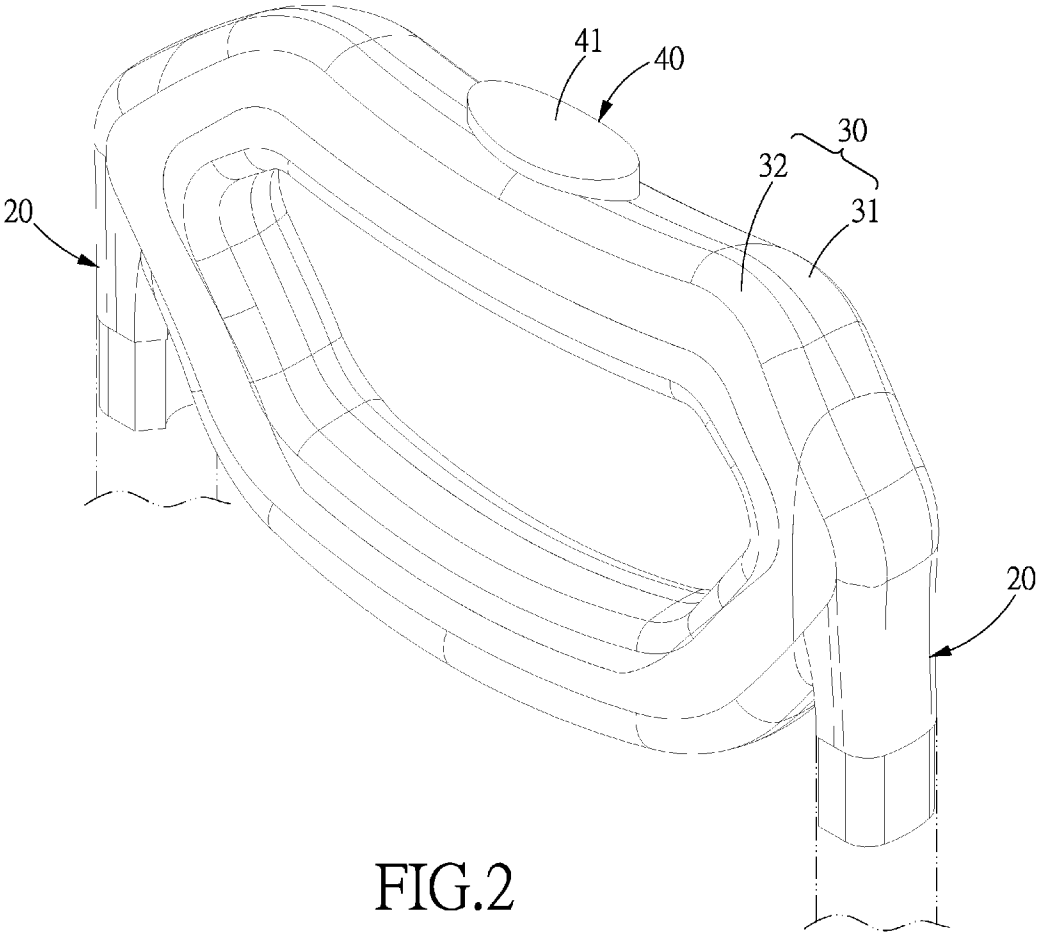
FIG. 2 shows an embodiment of a rotating handle apparatus for a luggage case in accordance with the present invention.
Figure 3:
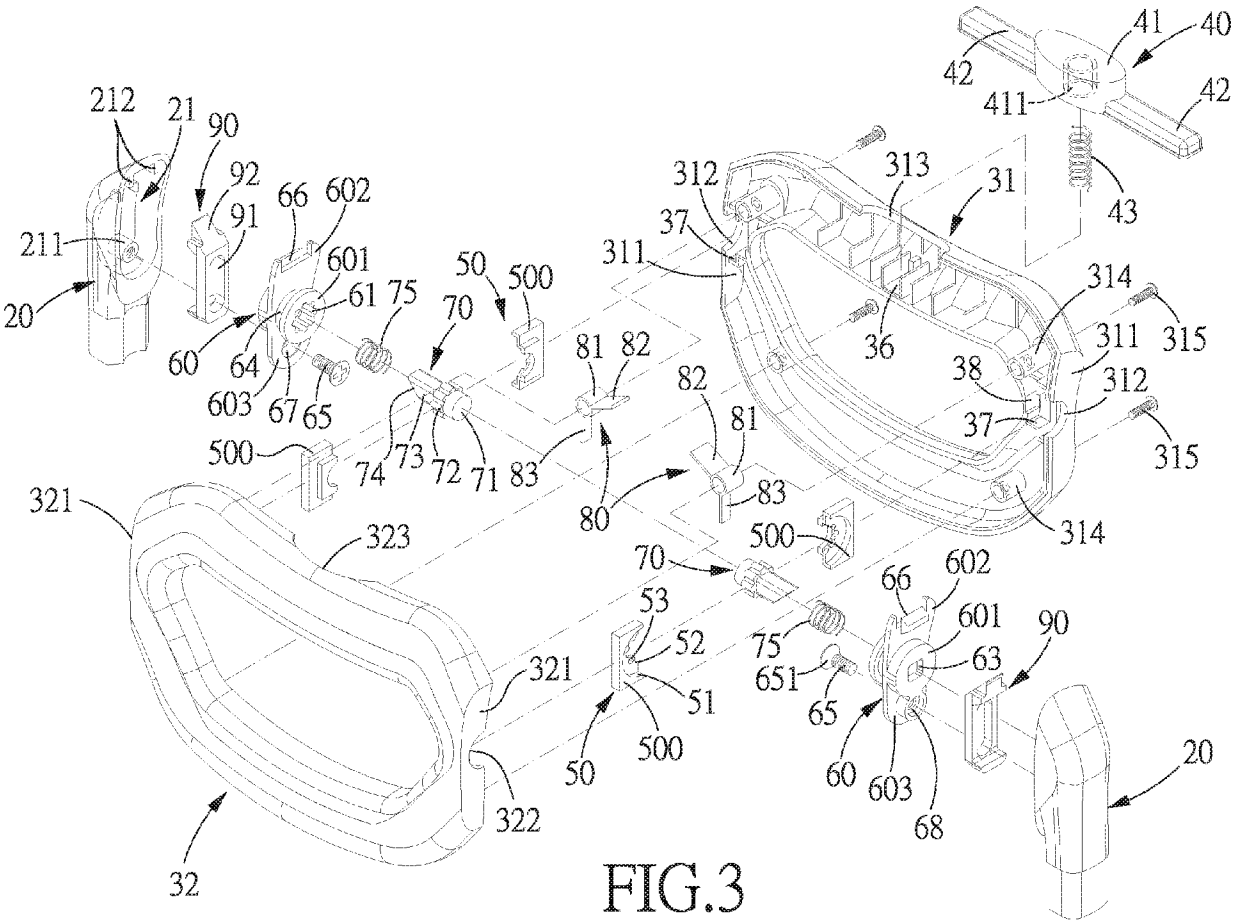
FIG. 3 is an exploded view of the rotating handle apparatus for a luggage case in accordance with the present invention.

The annular grip member 30 is disposed between the two connecting tubes 20 and defines an annular space R, as shown in FIG. 2. The annular grip member 30 includes a first half annular member 31 and a second half annular member 32 which is symmetrical to and abutted against the first half annular member 31 to form the annular grip member 30. The first half annular member 31 includes two opposite flat board portions 311, two notches 312 formed on the flat board portions 311, respectively, and a gap 313 which is defined between the two flat board portions 311. The second half annular member 32 includes two opposite flat board portions 321, two notches 322 formed on the two flat board portions 321, respectively, and a gap 323 defined between the two flat board portions 321. The first and second half annular members 31, 32 are clamped against each other in a manner that the flat board portions 311, 321 of the first and second half annular members 31, 32 define two assembling portions 33 aligned to the two assembling chambers 21, the notches 312, 322 of the first and second half annular members 31, 32 define two circular inserting holes 34 which are in communication with the annular space R and located at the two assembling portions 33, and the gaps 313 of the first and second half annular members 31, 32 define a through hole 35 which is located at the top edge of the annular grip member 30 and in communication with the annular space R. The first and second half annular members 31, 32 are provided with a plurality of locking portions 314, 324 which are located in the annular space R and are locked with one another by a plurality of fasteners 315.

Figure 4:
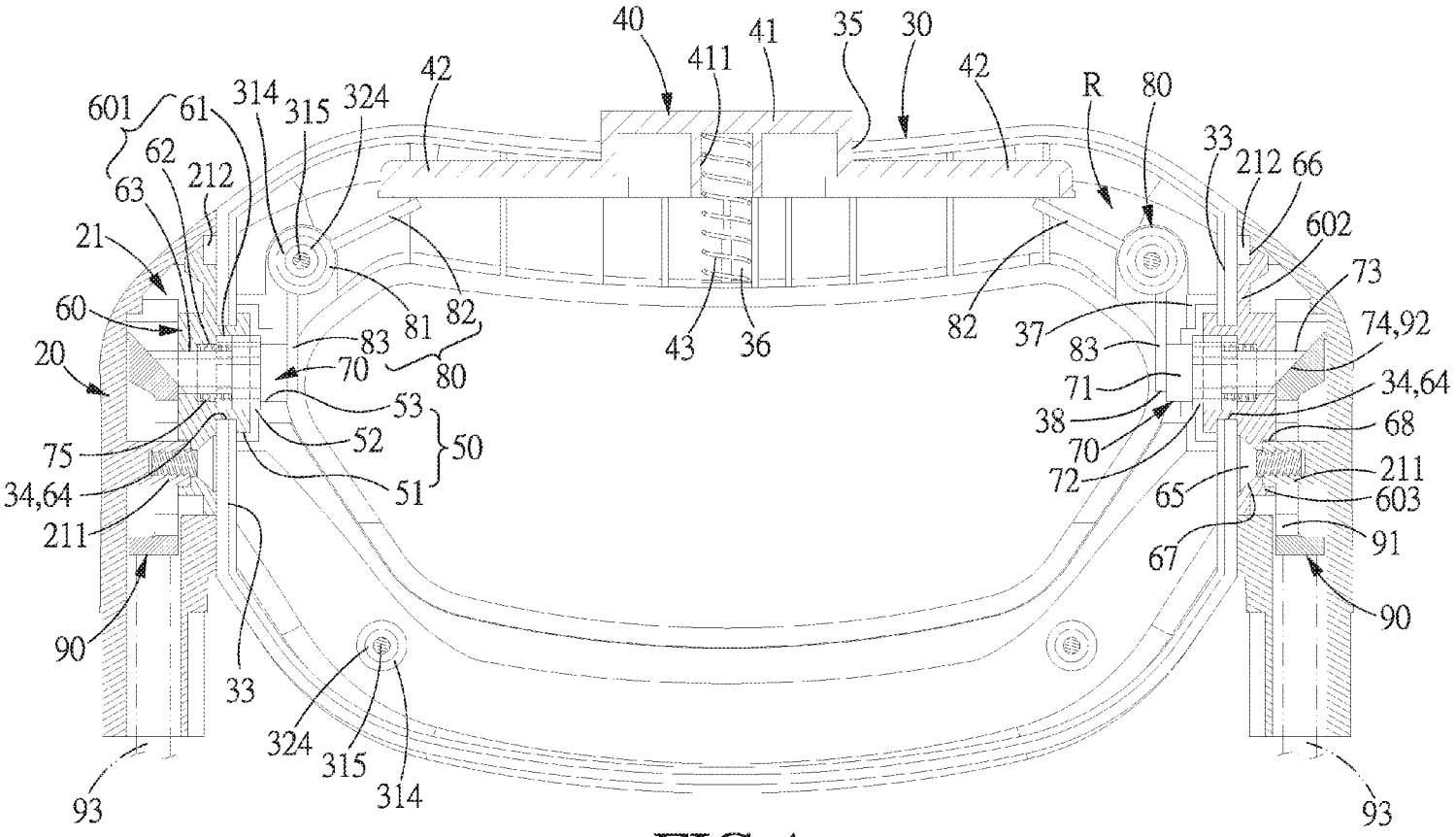
FIG. 4 is a cross sectional view showing an engagement state of the rotating handle apparatus for a luggage case in accordance with the present invention.
Figure 5:
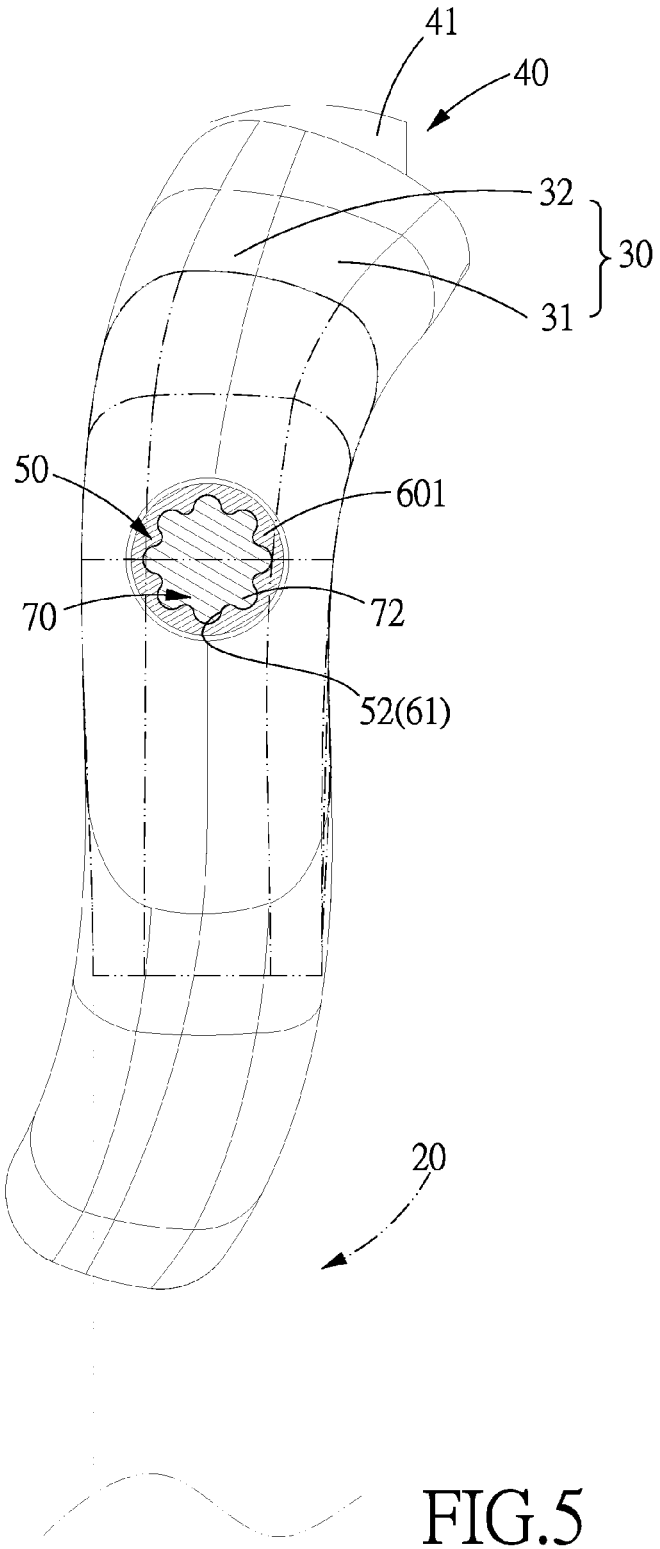
FIG. 5 is a cross sectional view showing an engagement state of the rotating handle apparatus for a luggage case in accordance with the present invention, wherein the ratchet section of the control shafts are engaged in the ratchet holes of the engaging member and the base.
Figure 6:
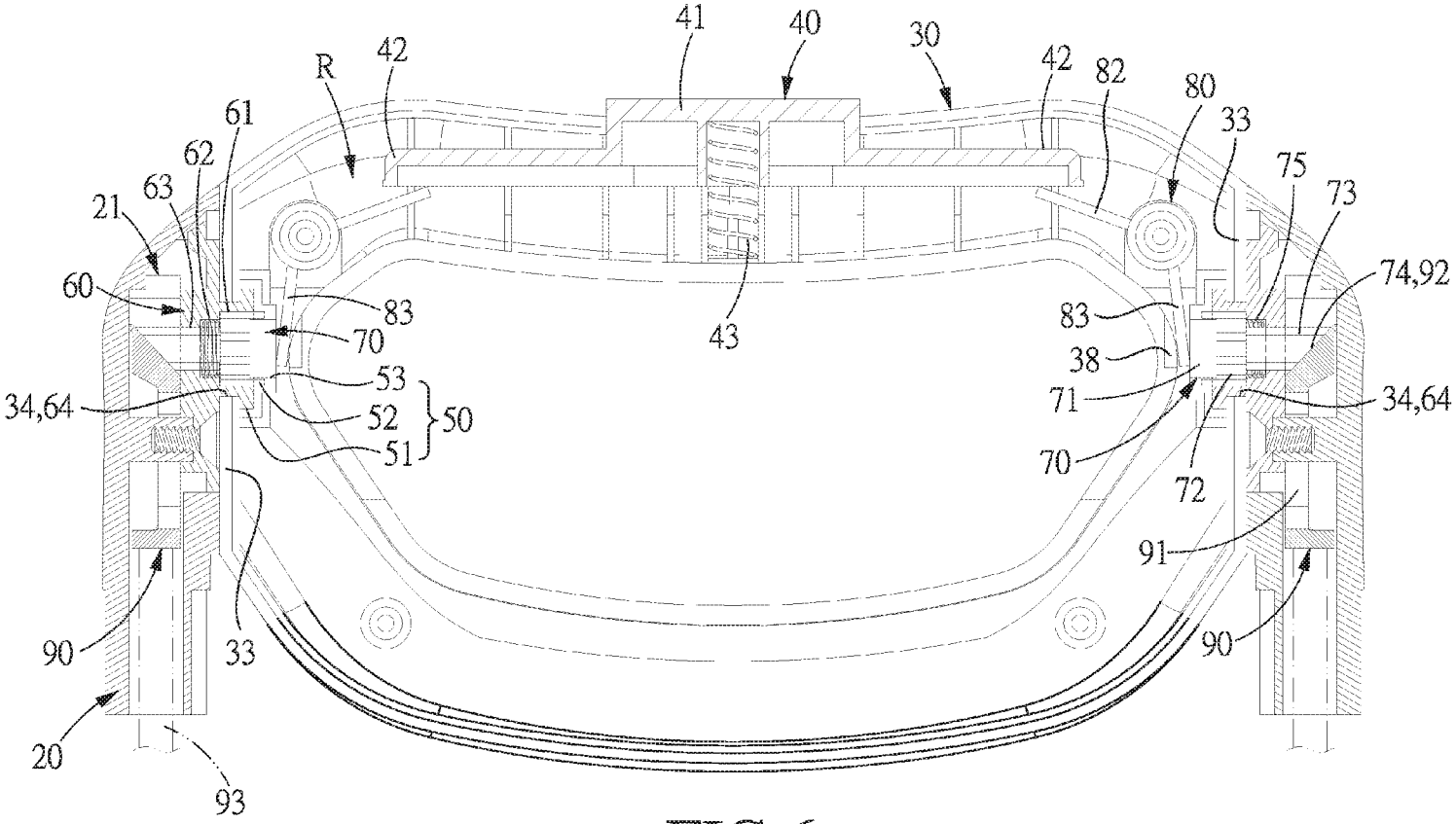
FIG. 6 is a cross sectional view showing a free-rotation state of the rotating handle apparatus for a luggage case in accordance with the present invention.

In this embodiment, the locking portions 314 of the first half annular member 31 have a concave shape, while the locking portions 324 of the second half annular member 32 have a convex shape, so that the locking portions 314 and 324 are engaged with each other, then the fasteners 315 are inserted through the locking portions 314, 324 to lock them together. As shown in FIGS. 4 and 6, in the annular space R of the annular grip member 30 is formed a receiving portion 36 which is aligned with the through hole 35 and provided for holding a compression spring 43 of the control button 40. The receiving portion 36 is formed by two separating members and two restricting ribs, and the structure of the receiving portion 36 is not limited to the above example. As shown in FIGS. 2 and 4, in the annular space R of the annular grip member 30 are formed two inserting portions 37 which are aligned with the two inserting holes 34 and are rectangular recesses for engaging with engaging members 50. The shape and structure of the inserting portions 37 are not limited to the above example. In an inner surface of the annular space R of the annular grip member 30 are formed recesses 38 which are formed aligned with the inserting holes 34 and provided for holding two driven members 80.

The control button 40 is disposed inside the annular grip member 30 and includes a button portion 41 and two arms 42 extending toward the two assembling portions 33 from the button portion 41. The button portion 41 is formed with a cavity 411 aligned with the receiving portion 36 of the annular grip member 30. The compression spring 43 has two ends received in the receiving portion 36 of the annular grip member 30 and the cavity 411 of the button portion 41. The control button 40 is pushed by the compression spring 43 to partially protrude out of the through hole 35, so that the control button 40 is elastically inserted in the through hole 35 of the annular grip member 30. Pressing the button portion 41 can make the annular grip member 30 rotate.

The two rotation mechanisms are disposed between the assembling portions 33 of the annular grip member 30 and the assembling chambers 21 of the two connecting tubes 20, respectively, and are driven to rotated by the control button 40, which consequently cause rotation of the annular grip member 30, so as to adjust the angle of the annular grip member 30 with respect to the connecting tubes 20. Each of the rotation mechanisms includes an engaging member 50, a base 60, a control shaft 70 and a driven member 80.

The engaging members 50 are disposed in the annular space R and engaged in the inserting holes 34. Each of the engaging members 50 includes two symmetrical assembling pieces 500 which are pressed against each other to form the rectangular engaging member 50. The two assembling pieces 500 are inserted through the inserting portions 37 and into the inserting holes 34 of the annular grip member 30. When the first and second half annular members 31, 32 are clamped pressed against each other to form the annular grip member 30, the engaging members 50 will also be pressed against each other to define a multi-stepped hole which tapers toward the annular space R and consists of a first circular hole 51, a middle ratchet hole 52 and a second circular hole 53 with a smaller diameter than the first circular hole 51.

The bases 60 are fixed in the assembling chambers 21 of the connecting tubes 20, and each are formed with a circular pillar to be inserted in the inserting holes 34 of the annular grip member 30, as shown in FIGS. 2 and 4. The circular pillar of each of the bases 60 is engaged in the first circular hole 51 of a corresponding one of the engaging members 50. The assembling portions 33 of the annular grip member 30 and the assembling chambers 21 of the connecting tubes 20 are rotatable with each other and pivotally connected by the bases 60. Each of the bases 60 is provided with a ratchet hole 61 formed in the shape of the ratchet hole 52 of the engaging members 50, a circular hole 62 and a polygonal hole 63.

In this embodiment, each of the bases 60 includes a seat portion 601 in the form of a circular pillar, and the ratchet hole 61, the circular hole 62 and the polygonal hole 63 are formed in the seat portion 601. On an outer surface of each of the bases 60 is formed an annular groove 64 which is located between the ratchet hole 61 and the circular hole 62 and provided for engaging with the peripheral edge of a corresponding one of the inserting holes 34 of the annular grip member 30. On two opposite sides of the outer surface of each of the bases 60 are provided a restricting portion 602 which is formed on the top edge of the assembling chamber 21 of the connecting tubes 20 and located corresponding to the circular hole 62 and the polygonal hole 63, and a positioning portion 603 which is fixed to the locking pin 211 of a corresponding one of the connecting tubes 20 by a fastener 65. The restricting portion 602 and the positioning portion 603 are in the form of a plate. At the end of each of the restricting portions 602 is formed an engaging concave portion 66 for engaging with the engaging protrusions 212 of the connecting tubes 20. Each of the positioning portions 603 is provided on one side thereof with a conical hole 67 for holding a head portion 651 of the fastener 65, and on an opposite side thereof with a positioning hole 68 for holding the locking pin 211 of the connecting tubes 20. The fastener 65 is inserted through the conical hole 67 and the positioning hole 68 and screwed into the locking pin 211 of the connecting tubes 20.

Each of the control shafts 70 is elastically disposed between the corresponding engaging member 50 and the base 60 and able to move back and forth repeatedly, as shown in FIG. 2. Each of the control shafts 70 includes a cylindrical section 71 inserted in the second circular hole 53 of the engaging member 50, a ratchet section 72 to be engaged in the ratchet holes 52, 61 of the engaging member 50 and the base 60, and a polygonal section 73 which is formed in the shape of the polygonal hole 63 and inserted through the ratchet hole 61, the circular hole 62 of the base 60 and into the polygonal hole 63. In this embodiment, as shown in FIGS. 4 and 6, onto the polygonal section 73 of the control shaft 70 is sleeved a compression spring 75 with one end pressed against the shoulder portion between the ratchet section 72 and the polygonal section 73 of the control shaft 70, and another end pressed against the connecting shoulder portion between the circular hole 62 and the polygonal hole 63 of the base 6, so that the control shaft 70 is elastically disposed between the engaging member 50 and the base 60 by the compression spring 75.

Each of the driven members 80 is pivotally disposed in the annular space R of the annular grip member 30, and includes a driven portion 82 abutted against a corresponding one of the arms 42 of the control button 40, and a drive portion 83 abutted against the end of the cylindrical section 71 of a corresponding one of the control shafts 70. In this embodiment, the two driven members 80 are each provided with a cylindrical pipe portion 81 connected to the driven and drive portions 82, 83, and the two cylindrical pipe portions 81 are pivotally sleeved onto the locking portions 314, 324, respectively, so that the driven members 80 are pivotally disposed at a fixed point in the annular space R of the annular grip member 30. When the ratchet section 72 of the control shaft 70 is engaged in the ratchet holes 52, 61 of the engaging member 50 and the base 60, the driven portion 82 is pushed by the cylindrical section 71 of the control shaft 70 into a corresponding one of the recesses 38.

What mentioned above are the structures of the first embodiment of the present invention, for a better understanding of the invention, its operating advantages and the specific objects attained by its uses, reference should be had to the following descriptive matter and FIGS. 2 and 4-8.

Pressing the control button 40 can cause movement of the driven members 80 and the control shafts 70 which are disposed between the annular grip member 30 and the connecting tubes 20, in such a manner that the arms 42 push the driven members 80, then the driven members 80 push each of the control shafts 70 to move between the corresponding engaging member 50 and the base 60. As a result, the ratchet section 72 of each of the control shafts 70 is moved into a free-rotation position, where the ratchet section 72 is moved out of the ratchet hole 52 of the engaging member 50 to allow free rotation of the annular grip member 30 with respect to the connecting tubes 20, as shown in FIG. 6. Or, the ratchet section 72 of each of the control shafts 70 moved into an engagement position, where the ratchet section 72 is moved into the ratchet holes 52, 61 of the engaging member 50 and the base 60 to prevent rotation of the annular grip member 30 with respect to the connecting tubes 20, as shown in FIG. 4.

The annular grip member 30 is pivotally connected to the connecting tubes 20 by seat portions 601 of the bases 60. Therefore, when in the free-rotation position, the ratchet section 72 of each of the control shafts 70 is pushed by the corresponding compression spring 75 to come into the ratchet hole 61 of the base 60 and the ratchet hole 52 of the engaging member 50 which is unrotatable, simultaneously, so that the annular grip member 30 is prevented from rotating with respect to the connecting tubes 20. When in the engagement position, each of the control shafts 70 is pushed toward the interior of the annular grip member 30 and pressed against the drive portion 83 of a corresponding one of the driven member 80, the drive portion 83 is pushed into the corresponding recess 38, and the driven portion 82 of the driven member 80 and the compression spring 43 push the control button 40 simultaneously, to make the button portion 41 partially protrude out of the annular grip member 30, forming the control button.

Figure 7:
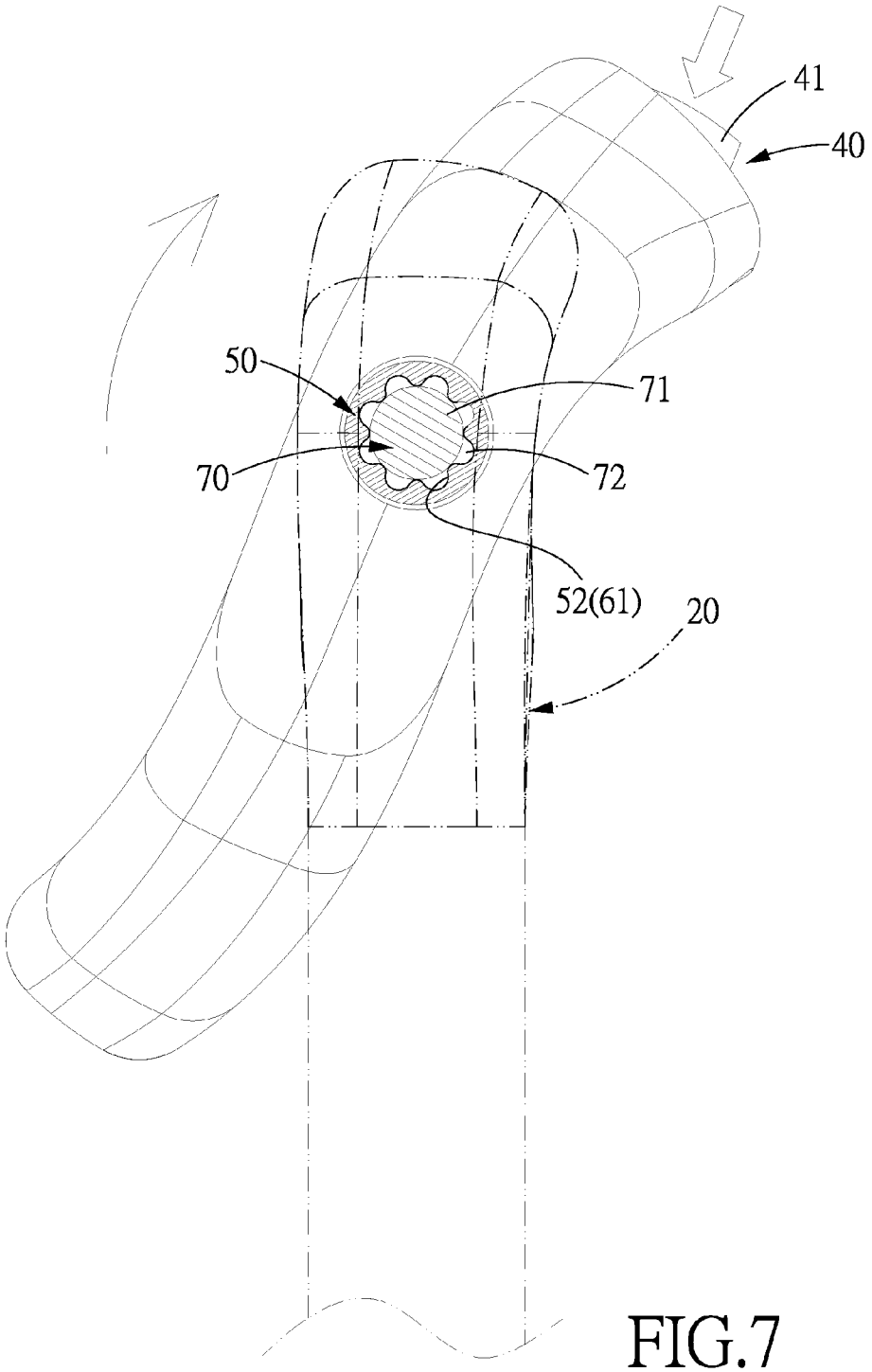
FIG. 7 is a cross sectional view showing the free-rotation state of the rotating handle apparatus for a luggage case in accordance with the present invention, wherein the ratchet section is moved out of the ratchet hole of the engaging member.
Figure 8:
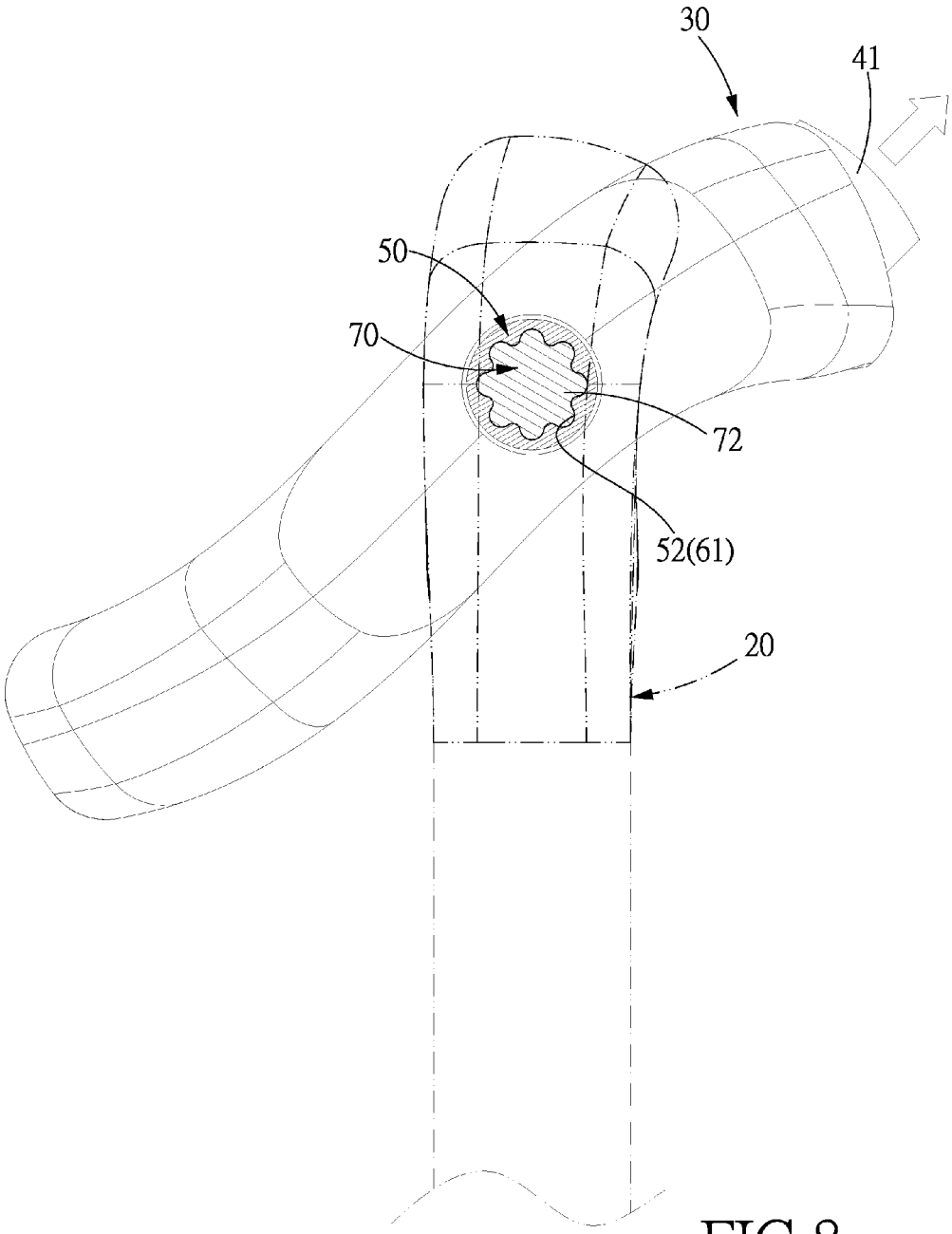
FIG. 8 is an operational view of FIG. 7 showing that the handle comes into the engagement position again after angle adjustment.

As shown in FIGS. 6 and 7, pressing the button portion 41 of the control button 40 can make the arms 42 push the driven portions 82 of the driven members 80, then the drive portions 83 of each of the driven members 80 push the corresponding control shaft 70 toward the corresponding one of the inserting holes 34 of the annular grip member 30, pushing the ratchet section 72 of the corresponding control shaft 70 out of the ratchet hole 52 of the corresponding one of the engaging members 50, so that the annular grip member 30 is able to rotate with respect to the connecting tubes 20. Hence, as shown in FIG. 7, keep pressing the control button 40 can adjust the annular grip member 30 to a desired angle. After adjustment, the control button 40 is released to make the control shafts 70 return to the engagement position, where the annular grip member 30 is fixed at the adjusted angle with respect to the connecting tubes 20, as shown in FIG. 8. Namely, the rotating handle apparatus for a luggage case in accordance with the present invention is capable of adjusting and locking the handle into a rotational position which is comfortable and ergonomically beneficial to a user.

Referring then to FIGS. 4 and 6, between each of the bases 60 and the assembling chamber 21 of a corresponding one of the connecting tubes 20 is disposed a drive member 90 which is connected to a retraction locking mechanism (not shown) of the retraction rods of the luggage case. At the end of the polygonal section 73 of each of the control shafts 70 is defined a slanting surface 74 which is inserted through the polygonal hole 63 of a corresponding one of the bases 60 and disposed between the base 60 and the assembling chamber 21 of the corresponding connecting tube 20. Each of the drive members 90 is an elongated block formed with a slot 91 for insertion of the locking pin 211 of the corresponding connecting tube 20, and has one formed with a slanting surface 92 for abutting against the slanting surface 74 of the control shafts 70, and has another end connected to the retraction locking mechanism (not shown) of the luggage case by a connecting cable 93.

When each of the control shafts 70 is pulled by the corresponding driven member 80 to move axially, the slanting surface 74 of the control shaft 70 will push against the slanting surface 92 of the drive member 90 to make the drive member 90 move up and down along the corresponding connecting tube 20 and base 60, and the drive member 90 moves with respect to the locking pin 211 of the corresponding connecting tube 20 within the restriction of the slot 91. Therefore, when the annular grip member 30 and the connecting tubes 20 are in the free-rotation position where the ratchet section 72 is moved out of the ratchet hole 52 of the engaging member 50, the movement of the drive member 90 will unlock the retracting locking mechanism via the connecting cable 93, allowing for length-adjustment of the retractable rods of the luggage case. When the annular grip member 30 and the connecting tubes 20 are in the engagement position where the ratchet section 72 of the control shafts 70 are engaged in the ratchet holes 52, 61 of the engaging member 50 and the base 60, since the control shafts 70 press against the driven members 80, the drive member 90 will move upward to lock the retracting locking mechanism via the connecting cable 93, fixing the retractable rods of the luggage case at a predetermined length.

While we have shown and described various embodiments in accordance with the present invention, it is clear to those skilled in the art that further embodiments may be made without departing from the scope of the present invention.

What is claimed is:

1. A rotating handle apparatus for a luggage case being disposed between two retractable rods of the handle of the luggage case, each of the retractable rods including a connecting tube, at one end of each of the connecting tubes being formed an assembling chamber, the handle-rotation apparatus comprising:

an annular grip member disposed between the two connecting tubes and defining an annular space, the annular grip member including two assembling portions aligned to the two assembling chambers, and two inserting holes which are in communication with the annular space and located at the two assembling portions, the annular grip member further including a through hole in communication with the annular space;

a control button disposed inside the annular grip member and including a button portion and two arms extending toward the two assembling portions from the button portion, the button portion being elastically inserted in the through hole of the annular grip member;

two rotation mechanisms disposed between the assembling portions of the annular grip member and the assembling chambers of the two connecting tubes, respectively, and being rotated by the control button to adjust an angle of the annular grip member with respect to the connecting tubes; wherein each of the rotation mechanisms comprises:

an engaging member which is disposed in the annular space and engaged in a corresponding one of the inserting holes, and includes a multi-stepped hole which consists of a first circular hole, a middle ratchet hole and a second circular hole with a smaller diameter than the first circular hole;

a base which is fixed in a corresponding one of the assembling chambers of the connecting tubes, each of the assembling portions of the annular grip members and a corresponding one of the assembling chambers of the connecting tubes are rotatable with each other and pivotally connected by the base, the base is provided with a ratchet hole formed in the shape of the ratchet hole of the engaging member, a circular hole and a polygonal hole;

a control shaft which is elastically disposed between the engaging member and the base and able to move back and forth repeatedly, the control shaft includes a cylindrical section inserted in the second circular hole of the engaging member, a ratchet section engaged in the ratchet hole of the engaging member and the base, and a polygonal section which is formed in the shape of the polygonal hole and inserted through the ratchet hole and the circular hole of the base and into the polygonal hole;

a driven member which is pivotally disposed in the annular space of the annular grip member, and includes a driven portion abutted against a corresponding one of the arms of the control button, and a drive portion abutted against one end of the cylindrical section of the control shaft;

wherein a locking pin is formed in each of the assembling chambers;

the inserting holes of the annular grip member are circular-shaped;

each of the bases includes a seat portion in the form of a circular pillar, and the ratchet hole, the circular hole and the polygonal hole are formed in the seat portion, on an outer surface of each of the bases is formed an annular groove which is located between the ratchet hole and the circular hole and provided for engaging with a peripheral edge of a corresponding one of the inserting holes of the annular grip member, on two opposite sides of the outer surface of each of the bases are provided a restricting portion which is to be fixed to a top edge of each of the assembling chambers of the connecting tubes and located corresponding to the circular hole and the polygonal hole, and a positioning portion which is fixed to the locking pin of a corresponding one of the connecting tubes by a fastener;

pressing the control button can cause movement of the driven member and the control shafts which are disposed between the annular grip member and the connecting tubes, in such a manner that the arms push the driven member, then the driven member push the control shaft to move between the engaging member and the base.

2. The rotating handle apparatus as claimed in claim 1, wherein two engaging protrusions are formed at the top edge of each of the assembling chambers;

the restricting portions and the positioning portions are in the form of a plate, at one end of each of the restricting portions is formed an engaging concave portion for engaging with the engaging protrusions of the connecting tubes, each of the positioning portions is provided on one side thereof with a conical hole for holding a head portion of the fastener, and provided on an opposite side thereof with a positioning hole for holding the locking pin of the connecting tubes, the fastener is inserted through the conical hole and the positioning hole and screwed into the locking pin of the connecting tubes.

3. A rotating handle apparatus for a luggage case being disposed between two retractable rods of the handle of the luggage case, each of the retractable rods including a connecting tube, at one end of each of the connecting tubes being formed an assembling chamber, the handle-rotation apparatus comprising:

an annular grip member disposed between the two connecting tubes and defining an annular space, the annular grip member including two assembling portions aligned to the two assembling chambers, and two inserting holes which are in communication with the annular space and located at the two assembling portions, the annular grip member further including a through hole in communication with the annular space;

a control button disposed inside the annular grip member and including a button portion and two arms extending toward the two assembling portions from the button portion, the button portion being elastically inserted in the through hole of the annular grip member;

two rotation mechanisms disposed between the assembling portions of the annular grip member and the assembling chambers of the two connecting tubes, respectively, and being rotated by the control button to adjust an angle of the annular grip member with respect to the connecting tubes; wherein each of the rotation mechanisms comprises:

an engaging member which is disposed in the annular space and engaged in a corresponding one of the inserting holes, and includes a multi-stepped hole which consists of a first circular hole, a middle ratchet hole and a second circular hole with a smaller diameter than the first circular hole;

a base which is fixed in a corresponding one of the assembling chambers of the connecting tubes, each of the assembling portions of the annular grip members and a corresponding one of the assembling chambers of the connecting tubes are rotatable with each other and pivotally connected by the base, the base is provided with a ratchet hole formed in the shape of the ratchet hole of the engaging member, a circular hole and a polygonal hole;

a control shaft which is elastically disposed between the engaging member and the base and able to move back and forth repeatedly, the control shaft includes a cylindrical section inserted in the second circular hole of the engaging member, a ratchet section engaged in the ratchet hole of the engaging member and the base, and a polygonal section which is formed in the shape of the polygonal hole and inserted through the ratchet hole and the circular hole of the base and into the polygonal hole;

a driven member which is pivotally disposed in the annular space of the annular grip member, and includes a driven portion abutted against a corresponding one of the arms of the control button, and a drive portion abutted against one end of the cylindrical section of the control shaft;

wherein a drive member is disposed between each of the bases and the assembling chamber of a corresponding one of the connecting tubes;

a locking pin is formed in the assembling chamber;

each of the bases includes a positioning portion which is fixed to the locking pin of a corresponding one of the connecting tubes by a fastener;

at one end of the polygonal section of each of the control shafts is defined a slanting surface which is inserted through the polygonal hole of a corresponding one of the bases and disposed between the bases and the assembling chamber of a corresponding one of the connecting tubes;

each of the drive members is an elongated block formed with a slot for insertion of the locking pin of the corresponding connecting tube, and has one formed with a slanting surface for abutting against the slanting surface of the control shafts;

when each of the control shafts moves axially, the slanting surface of the control shafts will push against the slanting surface of the corresponding drive member to relative movement of the locking pin of the corresponding connecting tube with respect to the slot of the drive member.

4. The rotating handle apparatus as claimed in claim 1, wherein a receiving portion which is aligned with the through hole is formed in the annular space of the annular grip member, the button portion is formed with a cavity aligned with the receiving portion of the annular grip member, a compressing spring is disposed between the receiving portion of the annular grip member and the cavity of the button portion, so that the control button is elastically inserted in the through hole of the annular grip member.

5. The rotating handle apparatus as claimed in claim 1, wherein the annular grip member includes a first half annular member and a second half annular member which is symmetrical to and abutted against the first half annular member to form the annular grip member, the first half annular member includes two opposite flat board portions, two notches formed on the flat board portions, respectively, and a gap which is defined between the two flat board portions, the second half annular member includes two opposite flat board portions, two notches formed on the two flat board portions, respectively, and a gap defined between the two flat board portions, the first and second half annular members are clamped against each other in a manner that the flat board portions of the first and second half annular members define the two assembling portions, the notches of the first and second half annular members define the two inserting holes, and the gaps of the first and second half annular members define the through hole, the first and second half annular members are provided with a plurality of locking portions which are located in the annular space and are locked with one another by a plurality of fasteners.

6. The rotating handle apparatus as claimed in claim 1, wherein the annular grip member includes a first half annular member and a second half annular member which is symmetrical to and abutted against the first half annular member to form the annular grip member, the first and second half annular members are provided with a plurality of concave locking portions and a plurality of convex locking portions which are located in the annular space and are locked with one another by a plurality of fasteners, in an inner surface of the annular space of the annular grip member is formed a recess aligned with the inserting holes, the two driven members are each provided with a cylindrical pipe portion connected to the driven and drive portions, and the two cylindrical pipe portions are pivotally sleeved onto the convex locking portions, respectively, so that the driven members are pivotally disposed at a fixed point in the annular space of the annular grip member.

7. The rotating handle apparatus as claimed in claim 1, wherein in the annular space of the annular grip member are formed two inserting portions which are aligned with the two inserting holes, each of the engaging members includes two symmetrical assembling pieces which are pressed against each other to form the engaging members which have a rectangular shape, and the engaging members are disposed in the annular space and engaged in the inserting holes.

8. The rotating handle apparatus as claimed in claim 1, wherein a compression spring is sleeved onto the polygonal section of each of the control shafts and has one end pressed against between the ratchet section and the polygonal section of the control shafts, and another end pressed against between the circular hole and the polygonal hole of each of the bases.

* * * * *